US007381277B2

(12) United States Patent
Gonterman et al.

(10) Patent No.: US 7,381,277 B2
(45) Date of Patent: Jun. 3, 2008

(54) FLAVORING A CIGARETTE BY USING A FLAVORED FILTER PLUG WRAP

(75) Inventors: Ricky A. Gonterman, Macon, GA (US); Douglas R. Hicks, McDonough, GA (US)

(73) Assignee: R.U. Reynolds Tobacco Company, Winston-Salem, NC (US)

( * ) Notice: Subject to any disclaimer, the term of this patent is extended or adjusted under 35 U.S.C. 154(b) by 589 days.

(21) Appl. No.: 10/901,662

(22) Filed: Jul. 29, 2004

(65) Prior Publication Data

US 2006/0021624 A1 Feb. 2, 2006

(51) Int. Cl.
*A24D 3/04* (2006.01)

(52) U.S. Cl. ..... 131/274; 131/335

(58) Field of Classification Search ..... 131/335, 131/274

See application file for complete search history.

(56) References Cited

U.S. PATENT DOCUMENTS

| | | | | |
|---|---|---|---|---|
| 2,998,820 | A | 9/1961 | Ades | |
| 3,339,558 | A | 9/1967 | Waterbury | |
| 3,397,700 | A | 8/1968 | Harlow et al. | |
| 3,420,241 | A | 1/1969 | Hind et al. | |
| 3,540,456 | A | 11/1970 | McGlumphy et al. | |
| 3,547,130 | A | 12/1970 | Harlow et al. | |
| 3,603,319 | A | 9/1971 | Badgett et al. | |
| 3,683,936 | A | 8/1972 | O'Neil, Jr. et al. | |
| 4,082,098 | A | 4/1978 | Owens, Jr. | |
| 4,305,411 | A | 12/1981 | Sprecker et al. | |
| 4,318,417 | A | 3/1982 | Hiroshi et al. | |
| 4,423,744 | A | 1/1984 | Berger | |
| 4,532,943 | A | 8/1985 | Nichols et al. | |
| 4,687,008 | A | 8/1987 | Houck, Jr. et al. | |
| 4,715,390 | A | 12/1987 | Nichols et al. | |
| 4,729,391 | A | 3/1988 | Woods et al. | |
| 5,115,823 | A | 5/1992 | Keritsis | |
| 5,137,034 | A | 8/1992 | Perfetti et al. | |
| 5,249,586 | A | 10/1993 | Morgan et al. | |
| 5,275,859 | A | 1/1994 | Phillips et al. | |
| 5,356,704 | A | 10/1994 | Phillips et al. | |
| 5,365,951 | A | 11/1994 | Arterbery et al. | |
| 5,396,909 | A | 3/1995 | Gentry et al. | |
| 5,538,018 | A * | 7/1996 | Chan et al. | 131/276 |
| 5,622,190 | A | 4/1997 | Arterbery et al. | |
| 5,746,230 | A | 5/1998 | Arterbery et al. | |

(Continued)

FOREIGN PATENT DOCUMENTS

EP 0797931 A1 1/1997

(Continued)

OTHER PUBLICATIONS

Browne, Colin, The Design of Cigarettes, Celanese Fibers Marketing Company, 1981, pp. 2-3 and 46-47.*

*Primary Examiner*—Carlos Lopez
(74) *Attorney, Agent, or Firm*—Charles I. Sherman; Middleton Reutlinger

(57) ABSTRACT

A method of flavoring a filter plug wrap of a smoking article, such as a cigarette, is disclosed. Furthermore, a method of incorporating flavoring into the plug wrap and using the plug wrap to wrap the filter of the smoking article is disclosed. A smoking article and a filter having a flavored filter plug wrap are also disclosed.

23 Claims, 3 Drawing Sheets

U.S. PATENT DOCUMENTS

| | | | | |
|---|---|---|---|---|
| 5,911,224 | A | 6/1999 | Berger | |
| 6,209,547 | B1 | 4/2001 | Koller et al. | |
| 6,302,114 | B1 | 10/2001 | Clarke et al. | |
| 6,325,860 | B1 | 12/2001 | Coleman, III | |
| 6,440,223 | B1 | 8/2002 | Dube et al. | |
| 6,595,218 | B1 | 7/2003 | Koller et al. | |
| 6,997,190 | B2 | 2/2006 | Stokes et al. | |
| 2002/0166563 | A1 | 11/2002 | Jupe et al. | |
| 2003/0178039 | A1* | 9/2003 | White et al. | 131/365 |

FOREIGN PATENT DOCUMENTS

| | | | |
|---|---|---|---|
| GB | 2229078 | A | 9/1990 |

* cited by examiner

FLAVORING A CIGARETTE BY USING A FLAVORED FILTER PLUG WRAP

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to methods of applying or incorporating cigarette flavoring into the filter plug wrap, the flavoring being semi-encapsulated, and a smoking article and filter resulting therefrom. More specifically, the present invention relates to methods whereby the filter plug wrap is flavored such that some of the flavoring will stay on the filter plug wrap and some of the flavoring will migrate into the filter plug, the cigarette paper, and the tobacco, and a smoking article and filter resulting therefrom.

2. Description of the Related Art

Flavor and aroma are important characteristics of smoking articles, such as cigarettes. Current methods of incorporating flavors into cigarettes involve spraying flavoring onto tobacco, inserting flavor pellets into the filter, inserting flavored string, injecting flavors into the filter, spraying flavoring onto the cigarette paper, or placing flavored strips inside the cigarette. Furthermore, certain cigarettes have filter segments which incorporate flavorants.

For example, U.S. Patent Pub. No 2002/0166563, invented by Jupe et al., teaches a flavorant added to carbon in a cigarette filter by spraying flavorant upon a batch of activated carbon in a mixing drum or in a fluidized bed with nitrogen as the fluidizing agent, wherein flavorant may then be sprayed onto the carbon in the bed. The carbon is placed in an area in the filter. Carbon, however, often yields an undesirable metallic flavor. Also, carbon often absorbs flavors in the mainstream smoke while smoking. Further, because of the volatile nature of some flavorants and aromas, they are often "lost" at least in part during cigarette manufacturing, packaging, and storage. Therefore, it is often necessary to increase the initial content of flavorants and aromas to compensate for the dissipated flavor and aroma, which is costly.

A smoking article with a flavor element suspended in a binding agent is desired. Flavor suspended in a binding agent is known in the art. Perhaps the most well-known example is LISTERINE® ORAL CARE STRIPS, the fast dissolving orally consumable films used to deliver flavors such as cinnamon and mint, breath deodorizing agents, and antimicrobial agents. U.S. Pat. No. 6,596,298, issued to Leung, et al., teaches a rapidly dissolving oral film comprised of flavors and antimicrobial agents suspended in binding agents selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, and mixtures thereof. U.S. Pat. No. 6,656,493, issued to Dzija, et al., and U.S. Pat. No. 6,740,332, issued to Zyck, et al., teach an edible film for oral cleansing and breath freshening having maltodextrines, fillers (e.g., microcrystalline cellulose (MCC)), and hydrocolloids (e.g., sodium alginate) as film forming agents.

A smoking article with a flavor element capable of flavoring the smoking article that is efficient to produce and yields a favored flavor is desired. Also, a smoking article with a flavor element that will not diminish during cigarette manufacturing, packaging, and storage is desired.

SUMMARY OF THE INVENTION

In view of known deficiencies associated with earlier smoking article filter elements, a smoking article with a cigarette flavoring applied to or incorporated into a filter plug wrap, whereby the filter plug wrap is comprised of flavor suspended in a binding agent, such as carboxymethyl cellulose (hereinafter "CMC"), is provided. Other binding agents known in the art, such as pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers (e.g., microcrystalline cellulose (MCC)), hydrocolloids (e.g., sodium alginate), and mixture thereof, may also be used.

In the instant invention, mainstream smoke passes through a carbon-based filter before passing through a flavored filter plug wrap. As such, the flavors, such as cinnamon and menthol, aren't subject to absorption by the carbon-based filter. The instant invention also provides a smoking article that is efficient to produce, one that yields a desirable flavor, and one that has flavoring that will not diminish during cigarette manufacturing, packaging, and storage.

Smoking articles, such as cigarettes, generally comprise a tobacco rod surrounded by a paper wrapper, and a cylindrical filter aligned in a coaxial relationship with the tobacco rod. Generally, the filter includes a cellulose acetate filter plug attached to the tobacco rod by tipping paper. After lighting a cigarette, a smoker draws mainstream smoke from the lit end of the tobacco rod, through the upstream end of the filter, and then through the downstream (or buccal) end of the cigarette.

The instant invention provides a method of consistently providing flavorful substances, which includes a flavored filter plug wrap having a composition of CMC or any of a number of other binding agents, as mentioned above, that can suspend flavorings and be degraded during the smoking process. Particularly, CMC is a semisynthetic water-soluble polymer in which $CH_2COOH$ groups are substituted on the glucose units of the cellulose chain, and generally functions as a binder, film former, and suspending agent. The flavoring is incorporated, such as encapsulated or suspended, into the material used as a filter plug wrap for the cigarette filter, and the filter plug wrap concentrically wraps the cigarette filter. The filter plug wrap is degraded by components generated by the smoking process, such as heat and/or water vapor, thereby releasing flavor. Some of the flavoring will stay on the plug wrap and some of the flavoring will migrate to the filter plug, the cigarette paper, and the tobacco.

Since the mainstream smoke must pass through the flavored filter plug wrap located in the filter, the flavor release will remain consistent throughout smoking. During the smoking process, the flavor is transferred into the mainstream cigarette smoke and then to the smoker without the material being pyrolized. This method is particularly beneficial because it is used to bypass certain filter materials which the mainstream smoke passes through, allowing flavorings, such as cinnamaldehyde for example, to be used which would normally be captured by filter materials, such as carbon for example. The fact that the flavor is not heated is advantageous because flavor is degraded by heat. The binder which suspends the flavor serves to further protect the flavor from heat and oxidization due to air exposure.

The flavored filter plug wrap can wrap the outside of a cigarette filter and can also wrap the core of a coaxial filter, perhaps in combination with an outer flavored filter plug wrap. The flavoring agents can range from traditional cigarette flavors, such as menthol and burley, to non-traditional cigarette flavors, such as cinnamon.

For a better understanding of the present invention, together with other and further objects thereof, reference is made to the following description, taken in conjunction with the accompanying drawings, and its scope will be pointed out in the appending claims.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

While this invention is susceptible of embodiments in many different forms, there are shown in the Figures and will herein be described in detail, preferred embodiments of the invention with the understanding that the present disclosure is to be considered as an exemplification of the principles of the invention, and is not intended to limit the broad aspects of the invention to the embodiments illustrated.

Figure 1:
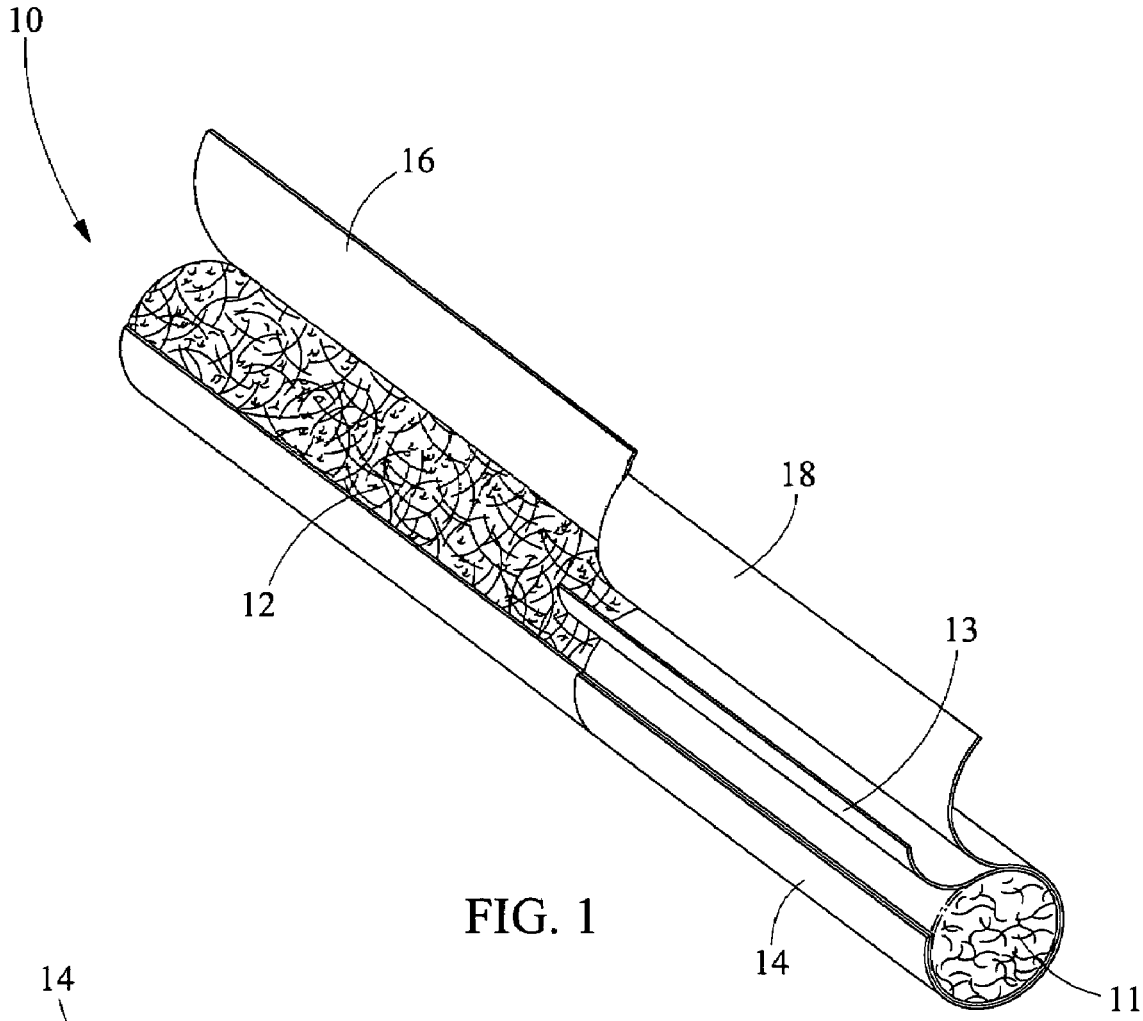
FIG. 1 is a perspective view of the filter end of a first embodiment of a smoking article according to the instant invention in a partially unwrapped condition.
Figure 2:
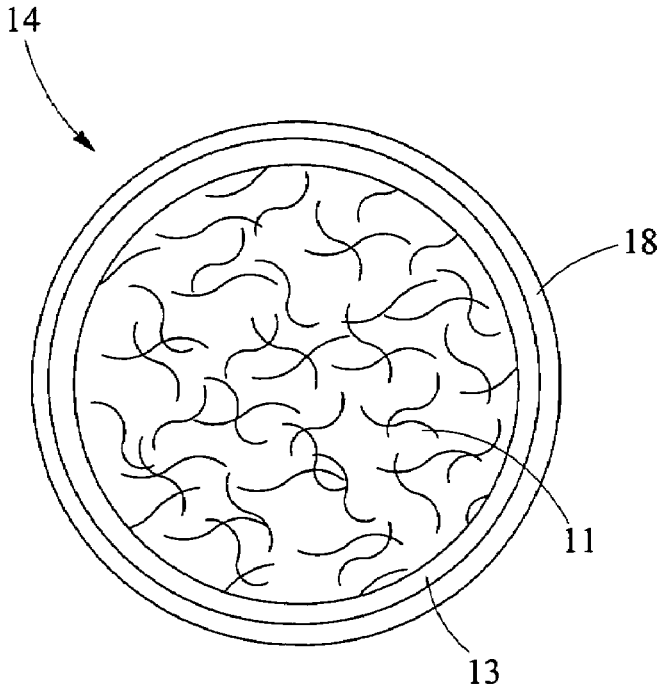
FIG. 2 is an end view of the filter of FIG. 1.

Referring to FIGS. 1 and 2, an embodiment of the present invention provides a smoking article 10 comprising a rod 12 of smokable material, such as tobacco, and a filter 14 attached thereto with tipping paper 18. The tobacco rod 12 may be wrapped with a conventional cigarette paper wrapper 16. The filter 14 includes a filter plug 11, such as for example cellulose acetate plug or other fibrous or webbed material, circumscribed with a filter plug wrap 13. Tipping paper 18 circumscribes the filter plug wrap 13. Mainstream smoke is generated by and drawn from the tobacco rod 12 and through the filter 14 upon lighting the smoking article 10 and inhaling.

The filter plug wrap 13 has a composition of carboxymethylcellulose (hereinafter referred to as "CMC") or any of a number of other binding agents that can suspend flavoring agents as described above. The method of adding flavorings is known in the art. The flavored filter plug wrap 13 is positioned around the filter plug 11 such that some of the flavoring will stay on the filter plug wrap 13 and some of the flavoring will migrate to the filter plug 11, the tipping paper 18, the paper wrapper 16, and the tobacco rod 12. The flavored filter plug wrap 13 can be applied during the cigarette manufacturing process. The amount of flavored filter plug wrap 13 per cigarette can vary, depending on factors such as the size of the flavored filter plug wrap 13, and the concentration of flavors suspended in the flavored filter plug wrap 13. As mainstream smoke is drawn upstream through the filter 14, flavor is consistently released into mainstream smoke as it passes through the filter plug 11 wrapped in the flavored filter plug wrap 13.

Figure 3:
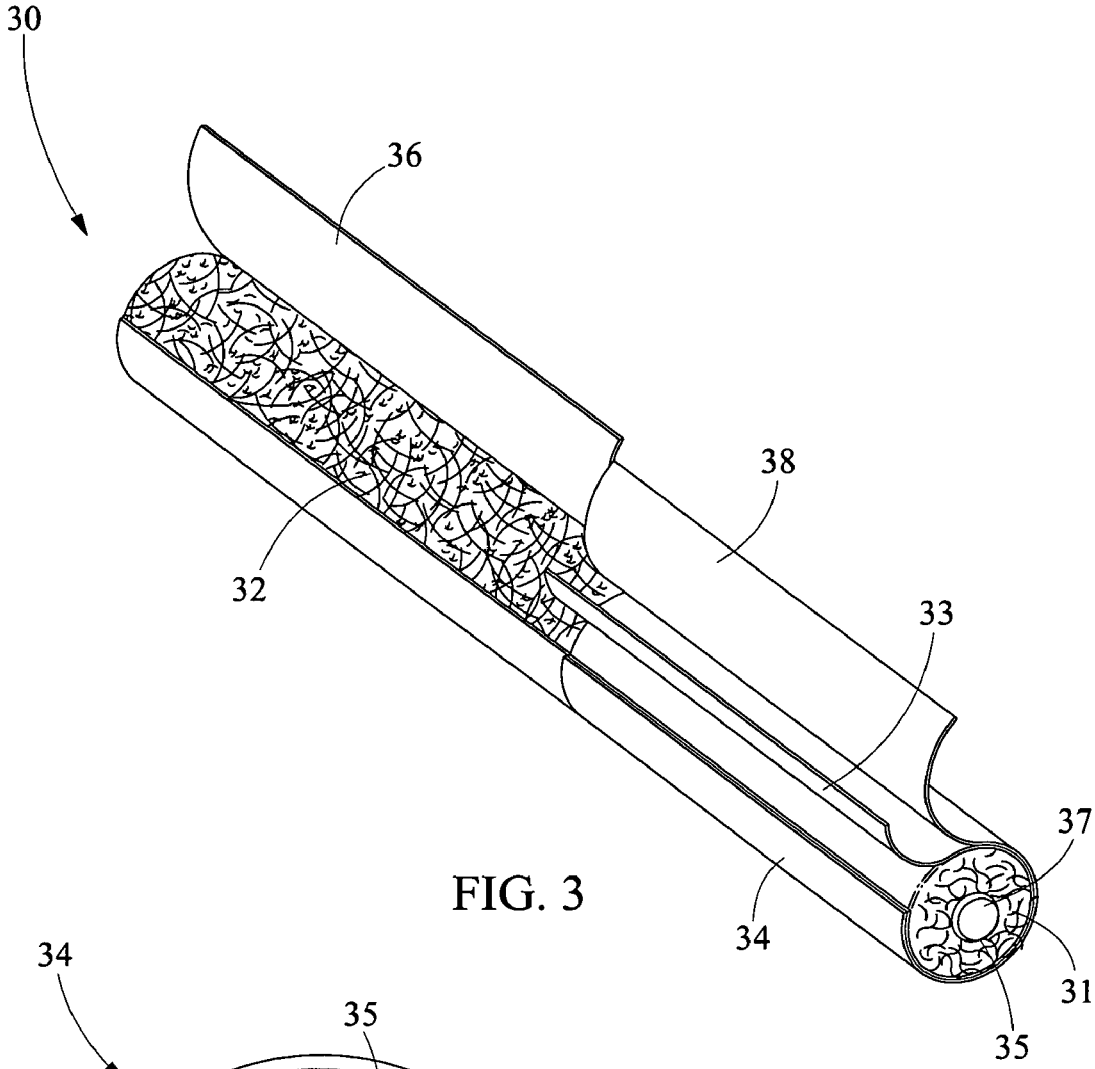
FIG. 3 is a perspective view of the filter end of a second embodiment of a smoking article according to the instant invention in a partially unwrapped condition.
Figure 4:
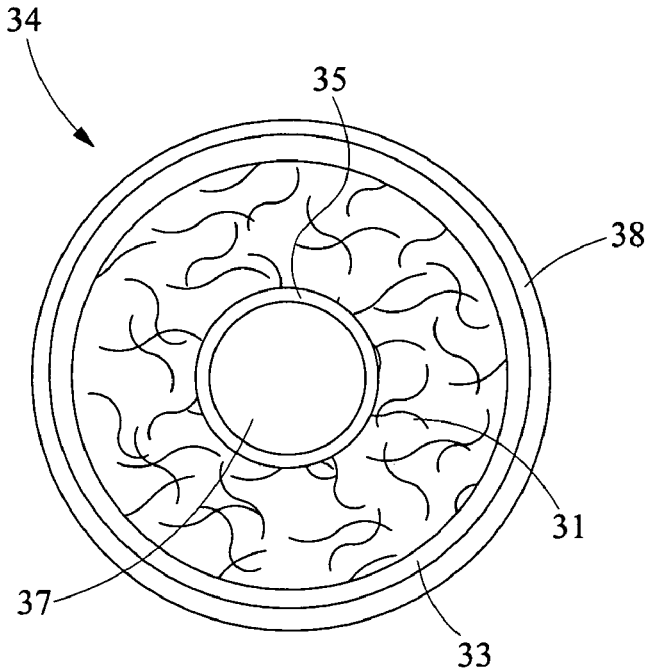
FIG. 4 is an end view of the filter of FIG. 3.

Referring to FIGS. 3 and 4, an embodiment of the present invention provides a smoking article 30 comprising a rod 32 of smokable material, such as tobacco, and a filter 34 attached to the rod 32. The tobacco rod 32 may be wrapped with a conventional cigarette paper wrapper 36. The filter 34 includes a filter plug 31, such as for example cellulose acetate plug or other fibrous or webbed material, circumscribed with a first flavored filter plug wrap 33. Tipping paper 38 circumscribes the first flavored filter plug wrap 33. Centrally disposed within the filter plug 31 is a filter core 37 circumscribe by a second flavored filter plug wrap 35.

The first and second flavored filter plug wraps 33, 35 are positioned such that some of the flavoring will stay on the plug wraps 33, 35 with a majority of the flavoring migrating to the filter plug 31, the tipping paper 38, the paper wrapper 36, the tobacco rod 32, and the filter core 37. The first and second flavored filter plug wraps 33, 35 can be applied during the cigarette manufacturing process. The amount of flavored filter plug wraps 33, 35 per cigarette can vary, depending on factors such as the size of the flavored filter plug wraps 33, 35 and the concentration of flavors suspended in the wraps 33, 35. As mainstream smoke is drawn upstream through the filter 34, flavor is consistently released into mainstream smoke as it passes through the filter plug 31 having the first and second flavored filter plug wraps 33, 35.

Figure 5:
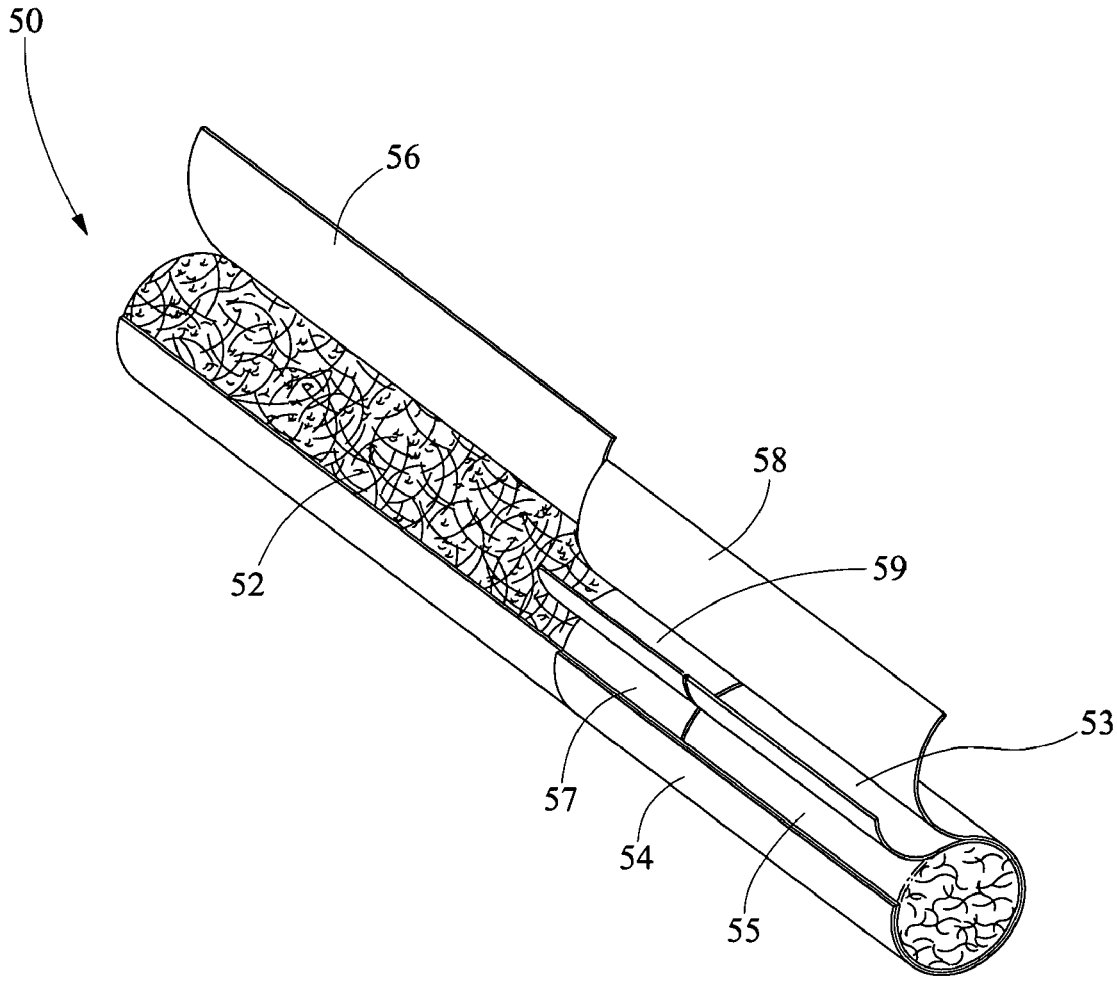
FIG. 5 is a perspective view of the filter end of a third embodiment of a smoking article according to the instant invention in a partially unwrapped condition.

Referring to FIG. 5, an embodiment of the present invention provides a smoking article 50 comprising a rod 52 of smokable material, such as tobacco, and a filter 54 attached thereto with tipping paper 58. The tobacco rod 52 may be wrapped with a conventional cigarette paper wrapper 56. The filter 54 can be a multi-component filter. FIG. 5 shows a filter 54 divided into a carbon-based filter segment 57 and a fibrous filter segment 55, such as cellulose acetate or another webbed material. The carbon-based filter segment 57 can be circumscribed with a regular plug wrap 59, while the fibrous filter segment 55 can be circumscribed with a flavored filter plug wrap 53. The tipping paper 58 circumscribes both the regular plug wrap 59 and the flavored filter plug wrap 53. Mainstream smoke is generated by and drawn from the tobacco rod 52 and through the filter 54 upon lighting the smoking article 50 and inhaling.

The flavored filter plug wrap 53 is positioned around the fibrous filter segment 55 such that some of the flavoring will stay on the flavored filter plug wrap 53 and some of the flavoring will migrate to the fibrous filter segment 55. As mainstream smoke is drawn upstream through the filter 54, the smoke first passes through the carbon-based filter segment 57 and subsequently through the fibrous filter segment 55, wherein flavor is released from the flavored filter plug wrap 53 into the mainstream smoke. Little, if any, of the flavor on the flavored filter plug wrap 53 is subject to adsorption in the carbon-based filter segment 57. As such, the smoker will receive most of the flavor from the flavored filter plug wrap 53.

EXAMPLE 1

A menthol flavorant was applied to a filter plug wrap 13 to determine the amount of flavor transfer to smoke. The approximate weight of material in the flavored filter plug wrap 13 was 33 mg per 27 mm of filter 14. Due to loss of menthol flavoring during the manufacturing of the flavored filter plug wrap 13, 0.58% of menthol was actually in the sample used for experimentation. Since 0.58% of the sample was menthol and the flavored filter plug wrap 13 weighed 33 mg, 0.191 mg of menthol were present in the flavored filter plug wrap 13. Smoke menthol showed 0.02 mg per cigarette, so approximately 10% of the menthol transferred to the smoke from the flavored filter plug wrap 13.

The foregoing detailed description is given primarily for clearness of understanding and no unnecessary limitations are to be understood therefrom, for modifications will become obvious to those skilled in the art upon reading this disclosure, and may be made without departing from the spirit of the invention and scope of the appended claims. In that regard, the instant invention may be practiced with cigarettes of various circumferences, narrow and wide.

We claim:

1. A method for forming a flavored filter for a smoking article, comprising the steps of:

suspending a flavoring agent in a binding agent selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers, hydrocolloids, and mixtures thereof, to form a flavorant;

adding said flavorant to a filter plug wrap to form a flavored filter plug wrap; and circumscribing a filter plug of said smoking article with said flavored filter plug wrap.

2. The method of claim 1, wherein said flavored filter plug wrap is also circumscribed about a filter core centrally disposed within said filter plug of said smoking article.

3. A method for providing a smoking article filter with flavor, comprising the steps of:

providing a flavorant comprised of a flavor suspended in carboxymethylcellulose;

adding said flavorant to a filter plug wrap to form a flavored filter plug wrap;

and circumsribing a filter plug of said smoking article with said flavored filter plug wrap.

4. The method of claim 3, wherein said flavored filter plug wrap is also circumscribed about a filter core centrally disposed within a filter plug of said filter.

5. A smoking article, comprised of a tobacco rod and a filter, said filter including a filter plug circumscribed with a flavored filter plug wrap, said flavored filter plug wrap including a flavor compound suspended in a carboxymethylcellulose binding agent.

6. The smoking article of claim 5 wherein said flavored filter plug wrap also circumscribes a filter core of said filter, said filter core centrally disposed within said filter plug.

7. A smoking article, comprising:

a tobacco rod wrapped in a paper wrapper; and a filter attached in axial alignment to said tobacco rod with tipping paper;

wherein said filter comprises:

a filter plug; and a flavored filter plug wrap circumscribing said filter plug comprised of a binding agent and a flavor suspended in said binding agent, wherein said binding agent is selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers, hydrocolloids, and mixtures thereof.

8. The smoking article of claim 7, wherein said flavored filter plug wrap also circumscribes a core of said filter, said core being centrally disposed within said filter plug.

9. The smoking article of claim 7, wherein said filter plug is cellulose acetate.

10. A smoking article, comprising:

a tobacco rod wrapped in a paper wrapper; and a filter attached to said tobacco rod in axial alignment with tipping paper;

wherein said filter comprises:

a fibrous filter segment circumscribed by a flavored filter plug wrap, said flavored filter plug wrap comprised of a binding agent and a flavor; and a carbon based filter segment circumscribed by a plug wrap, said carbon based filter segment positioned between said tobacco rod and said fibrous filter segment.

11. The smoking article of claim 10, wherein said binding agent is selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers, hydrocolloids, and mixtures thereof.

12. The smoking article of claim 10, wherein said flavored filter plug wrap circumscribes a core of said filter, said core being centrally disposed within said filter plug.

13. The smoking article of claim 10, wherein said fibrous filter segment is cellulose acetate.

14. A filter for a smoking article, comprising:

a filter plug; and a flavored filter plug wrap circumscribing said filter plug, wherein said flavored filter plug wrap is comprised of a flavor compound suspended in carboxymethylcellulose.

15. The filter of claim 14, wherein said filter plug is comprised of cellulose acetate.

16. A filter for a smoking article, comprised of:

a filter plug; and a flavored filter plug wrap, wherein said flavored filter plug wrap is comprised of a flavor compound suspended in a binding agent selected from a group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers, hydrocolloids, and mixtures thereof, and wherein said flavored filter plug wrap circumscribes said filter plug.

17. The filter of claim 16, wherein said filter plug is comprised of cellulose acetate.

18. The filter of claim 16, wherein said flavored filter plug wrap also circumscribes a filter core centrally disposed within said filter plug.

19. A filter for a smoking article, comprised of:

a carbon based filter segment circumscribed with a plug wrap; and a fibrous filter segment circumscribed with a flavored filter plug wrap;

wherein said flavored filter plug wrap is comprised of a flavor compound suspended in a binding agent, said carbon based filter segment being secured in axial alignment with said fibrous filter segment.

20. The filter of claim 19, wherein said fibrous filter segment is comprised of cellulose acetate.

21. The filter of claim 19, wherein said binding agent is selected from the group consisting of carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, maltodextrines, fillers, hydrocolloids, and mixtures thereof.

22. The filter of claim 19, wherein said flavored filter plug wrap also circumscribes a filter core centrally disposed within said fibrous filter segment.

23. The filter of claim 19, wherein mainstream smoke passes first through said carbon based filter segment and second through said fibrous filter segment.

* * * * *